United States Patent [19]

DeLong et al.

[11] Patent Number: 5,056,577

[45] Date of Patent: Oct. 15, 1991

[54] OFFICE SPACE DIVIDING SYSTEM

[75] Inventors: Ronald B. DeLong; James R. Bouse, both of Belmont; John P. Conner, Grandville; Charles G. Raabe, Leonard Heights; William L. Nieboer, Grand Rapids, all of Mich.

[73] Assignee: Westinghouse Electric Corp., Pittsburgh, Pa.

[21] Appl. No.: 523,772

[22] Filed: May 15, 1990

[51] Int. Cl.[5] ..... A47G 5/00

[52] U.S. Cl. ..... 160/135; 52/239

[58] Field of Search ..... 160/135, 351, 379, 381; 52/239

[56] References Cited

U.S. PATENT DOCUMENTS

| | | | |
|---|---|---|---|
| 3,592,289 | 7/1971 | Aysta | 160/135 |
| 3,788,378 | 1/1974 | Sobel | 160/135 |
| 3,871,153 | 3/1975 | Birum | 52/239 X |
| 4,100,709 | 7/1978 | Good | 160/135 X |
| 4,104,838 | 8/1978 | Hage et al. | 160/135 X |
| 4,185,430 | 1/1980 | Gartung | 52/239 X |
| 4,567,698 | 2/1986 | Morrison | 160/135 X |
| 4,631,881 | 12/1986 | Charman | 160/135 X |
| 4,828,005 | 5/1989 | Notley | 160/135 X |
| 4,891,922 | 1/1990 | Hozer et al. | 160/135 X |
| 4,907,384 | 3/1990 | Underwood | 52/239 X |
| 4,947,601 | 8/1990 | McGuire | 52/239 |
| 4,949,518 | 8/1990 | Nagel et al. | 52/239 |
| 4,958,671 | 9/1990 | Bove | 160/135 |

*Primary Examiner*—David M. Purol

*Attorney, Agent, or Firm*—D. R. Lackey

[57] ABSTRACT

An office space dividing system which includes rectangular post-supported panels having central cores and upper wire troughs. Each panel includes two stiles and upper and lower rails constructed of tubular metallic members having the same substantially rectangular cross-sectional configuration which includes a longitudinal channel. The stiles and rails are arranged to define four corners each having two adjacent unobstructed openings. A right angle reinforcing member is press fit into the adjoining openings to provide four square corners which are maintained by staking. The stiles and lower rail are oriented such that the longitudinal channels support the central core. The upper rail is inverted, with the longitudinal channel supporting the wire trough. A spanner extends across each post, between adjacent panels, from wire trough to wire trough. Post caps, panel caps, and four plastic corners on each panel complete the system.

32 Claims, 10 Drawing Sheets

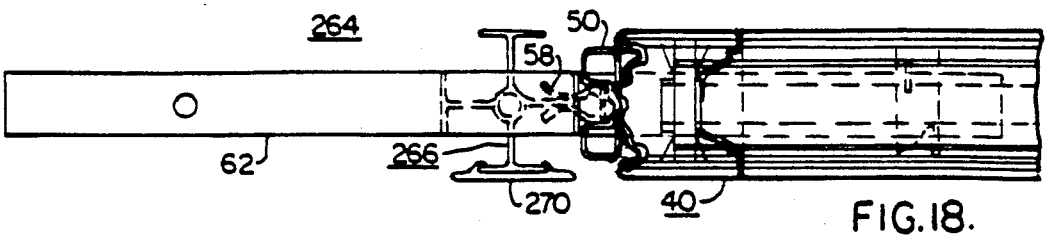
FIG.18.
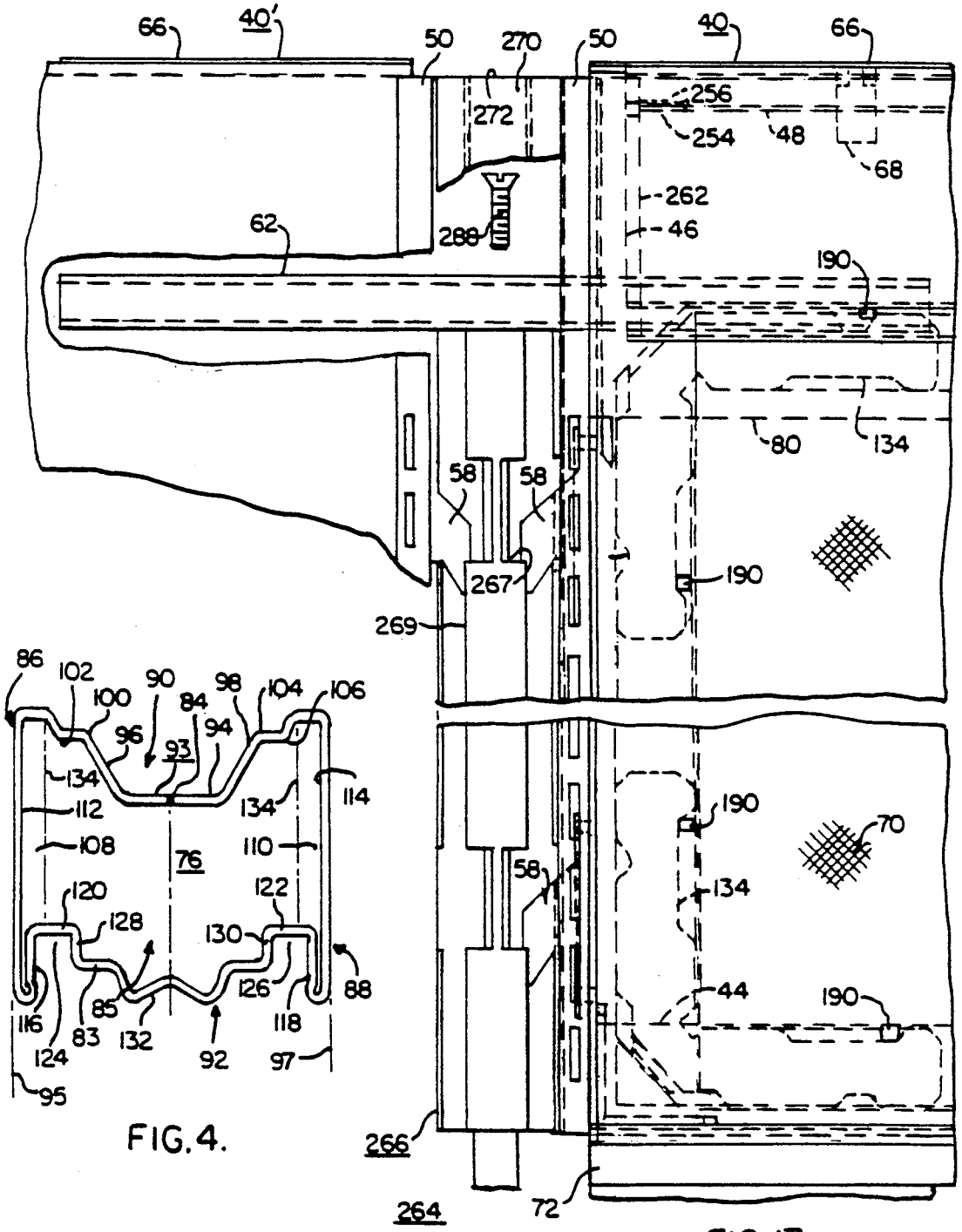
FIG.17.
FIG.4.

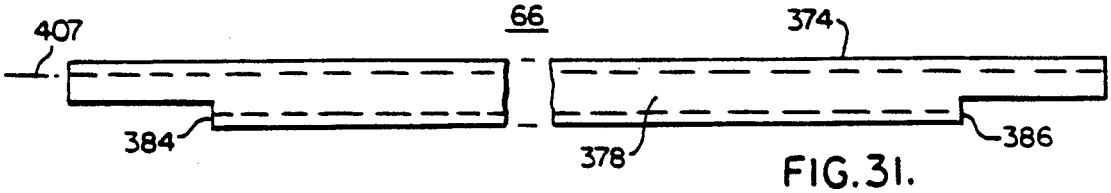
FIG. 31.
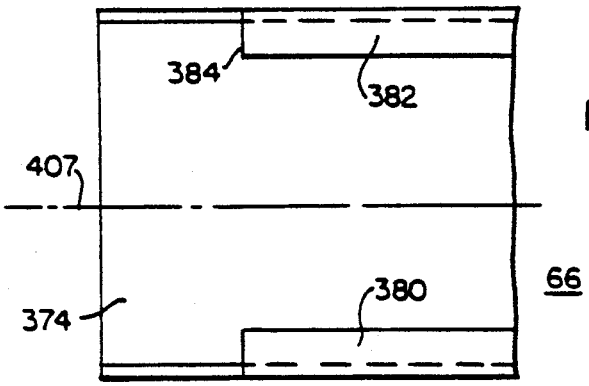
FIG. 32.
FIG. 33.
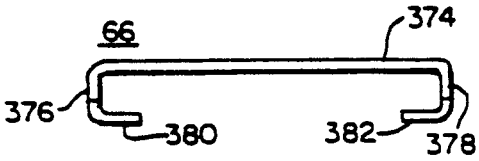
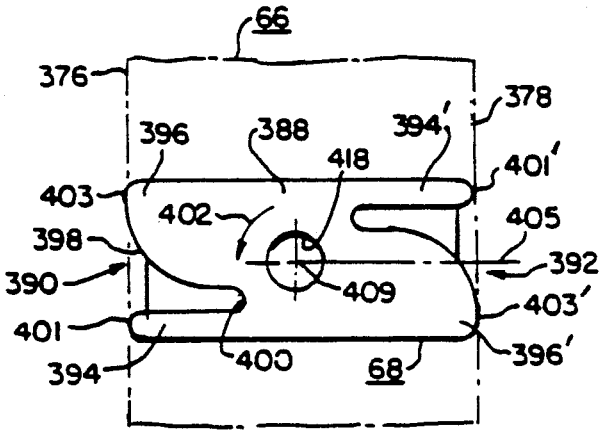
FIG. 35.
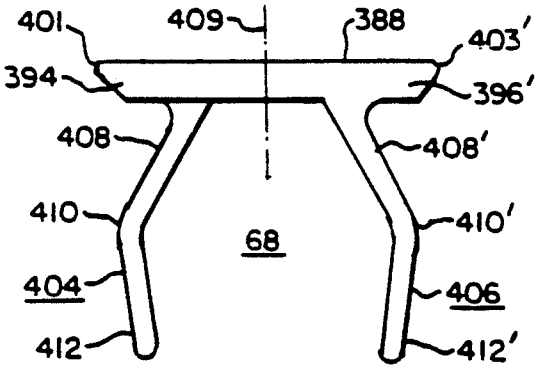
FIG. 34.

OFFICE SPACE DIVIDING SYSTEM

TECHNICAL FIELD

The invention relates in general to open plan office space dividing partition systems, and more specifically to the construction of space dividing panels used in such systems.

BACKGROUND ART

Open plan office space dividing partition systems utilize panels as the main system element, and the manufacturing cost of the panels represents a major fraction of the cost of any system. It is thus important, and it is an object of the present invention, to reduce the manufacturing costs of such systems, without sacrificing strength, durability, and appearance.

The increasing usage of computers and associated electrical equipment in modern offices has greatly increased the number of communication wires required to be concealed within space dividing partition systems. It is thus another object of the invention to provide a new and improved office space dividing system which has the capacity to carry a large number of communication wires.

SUMMARY OF THE INVENTION

Briefly, the present invention is an office space dividing system which includes new and improved rectangular panels having a high strength, accurate frame construction which requires no welding or grinding. The new panel construction quickly achieves and maintains the desired square corners, even when the frame is required to support a relatively heavy foamed-in-place gypsum core, which is the core element in a preferred embodiment of the invention. A large wire trough occupies the top of the panel, providing a large space for laying in communication wires which are routed to associated work stations, as well as providing rigid anchor points for panel to panel spanners which rigidize the system.

The panel frame construction includes first and second stiles and upper and lower rails, all constructed from the same roll formed tubular metallic stock. The ends of the stiles and rails are not mitered, but square, simplifying the cutting of the frame elements. Instead of butting the square ends of the rails against the stiles, or the square ends of the stiles against side rails, the inner side of each frame member, ie., the side which faces the frame window, is aligned with the square end of the adjoining member. In other words, the inner side of each rail is substantially aligned with a square end of each stile, and the inner side of each stile is substantially aligned with a square end of each rail. This arrangement provides adjoining unobstructed openings to the rails and stiles at each of the upper and lower corners of the frame.

Right angle metallic joining and reinforcing members are press fit into the adjoining rail and stile openings at each corner of the frame, with the tooling for performing the press fit operation squaring the corners as the press fits are made. Each right angle joining member has a leg portion which enters a frame and a leg portion which enters a rail. Each such leg portion is made up of two spaced, interconnected flat leg members stamped from a metallic sheet. Each flat leg member enters a specially shaped receiving pocket, with the receiving pockets being directly adjacent first and second opposite flat sides of the frame elements. The squared corners are maintained by staking the rails and stiles against the flat leg members of the press-fit right angle members, which are firmly held in position during the staking operation by the receiving pockets.

When the frame is to support a foamed-in-place gypsum core, one or more horizontally oriented metallic rods, with the number depending upon the height of the frame, are fixed between the inner surfaces of the stiles, by welding or riveting, to prevent outward bowing of the stiles.

The tubular stock from which the rails and stiles is constructed, in addition to the hereinbefore mentioned first and second flat sides, includes a side having an externally facing longitudinally extending central groove or channel. The side opposite to the channel side includes a pair of outwardly facing spaced spline grooves adjacent to the lateral edges of the side for receiving spline beads which hold outer covers, such as fabric covers, on the opposing major sides of a panel.

The first and second stiles and lower rail are oriented such that the central channel faces the frame window and the spline grooves are on the outer perimeter of the frame. The upper rail is inverted, relative to the orientation of the lower rail, such that the longitudinal central channel faces upwardly and thus outwardly. The first and second flat sides of each frame element are thus disposed in common front and back parallel planes, with the inner and outer facing sides of each frame element extending perpendicularly between the front and back planes of the frame.

The inwardly facing longitudinal central channels of the stiles and lower rail will firmly and reliably hold a foamed-in-place gypsum core, when such a core is used, and the inwardly facing spline grooves of the upper rail also assist in the core holding function.

A large metallic wire trough is fixed to the upper surface of the upper rail, with the bottom of the wire trough being complementary to the upwardly facing longitudinal channel of the upper rail, accurately seating and longitudinally directing the wire trough along the top of the frame. The top of the wire trough is upwardly open, with spline beads being inwardly formed adjacent to the longitudinally extending sides of the wire trough. There is still adequate spacing between the spline beads to enable a large number of communication wires to be laid into the open top of the wire trough.

Before an outer covering is fixed to a panel, each panel is provided with upper and lower plastic corners which engage exposed corners of the right angle joining members. The upper plastic corners extend along the relatively long vertical end edges of the wire trough, and the upper plastic corners have outwardly extending fingers which latch to suitably located openings in the wire trough. The upper and lower plastic corners have flat surfaces in the parallel front and back planes of the frame, to provide a smooth supporting surface for the panel coverings. The portions of the plastic corners which continue the outer perimeter of the frame have spline grooves aligned with the spline grooves of the rail, stile, or wire trough, as the case may be, to provide two continuous spline grooves around the outer perimeter of the frame for tightly holding two panel covers, one on each major flat side of the panel.

In a preferred embodiment of the invention, the panels are supported by posts, with the posts providing a desired center line modularity to the system. A slotted standard is fixed to each of the two vertically extending lateral edges of each frame, and hook-type support elements are attached thereto which engage hook receiving edges of an associated post. The long channel-seated metallic wire troughs and upper frame rails cooperatively form strong anchor points for metallic panel-to-panel spanners or rigidizers, which are also secured to the top of the post being spanned. The inner configuration of the wire trough at the bottom is channel shaped, with outwardly flared sides, and the spanner has an inverted U-shaped configuration. The depending leg portions of the inverted U-shaped configuration have portions bent to lie firmly against the angled sides of the wire trough, providing a wedging effect and additional resistance against relative movement between the spanners and wire troughs, resulting in a superior panel-to-panel rigidizing structure.

Post caps include three alignment portions when the post cap is associated with a post having an "unused" panel position, eg., a post capable of supporting four panels but which is only being used to support one, two or three panels. A post cover is placed on the side of the post not presently being used to support a panel. The three alignment portions include first depending alignment legs which telescope into the upwardly open ends of the slotted standards of the panels joined to the associated post, a second depending alignment leg for engaging each post cover, and a horizontally extending portion which underlies a panel cap. A panel cap snaps on to the top of each wire trough, substantially flush with the top of the wire trough.

In a metallic embodiment of the panel cap, the panel cap is formed from a sheet of metal into a substantially C-shaped cross sectional configuration. Panel cap retaining clips are provided, with each clip having a pair of spaced, horizontally oriented leg members at each longitudinal end, with one leg member of each pair being resiliently bendable. The resilient leg members of the clip, which are disposed at diagonally opposite corners, are deflected by depending legs of the metallic panel cap as each clip is positioned within the C-shaped configuration of the panel cap and then turned one-quarter of a turn. Thus, during assembly, the clip effectively has only two oppositely directed legs. The clip is retained in the desired assembled position with the panel cap as the flexible legs return to their unstressed positions, providing two spaced mounting points on each end of the clip which contact the depending legs of the panel cap to, resist turning and therefor removal of a clip once the legs of the clip are aligned perpendicular to the depending leg portions of the panel cap. Each panel cap retaining or mounting clip also has to resilient, depending leg portions which are inwardly biased by the spline groove structure of the wire trough, as the panel cap is forced to its seated position on top of a wire trough. As the panel cap reaches its desired assembled position, "knees" on the resilient, depending legs pass the bottoms of the spline groove structure, allowing the legs to flex outwardly towards their unbiased positions, to firmly but removably hold the clips and their associated panel cap on top of the wire trough.

DESCRIPTION OF THE DRAWINGS

The invention will become more apparent by reading the following detailed description in conjunction with the drawings which are shown by way of example only, wherein:

FIG. 4 is an end view of one of the elements of which the stiles and rails of the frame shown in FIG. 3 is constructed;

FIG. 17 is a fragmentary elevational view of a space dividing panel system constructed according to the teachings of the invention which illustrates two panels supported by a post;

FIG. 18 is a plan view of the system shown in FIG. 1, without one of the panels;

FIG. 31 is a side elevational view of a panel cap shown in FIG. 2;

FIG. 32 is a bottom view of the panel cap shown in FIG. 31;

FIG. 33 is an end view of the panel cap shown in FIG. 31;

FIG. 34 is an elevational view of a clip used to attach the panel cap shown in FIG. 31 to the wire trough shown in FIG. 11; and FIG. 35 is a plan view of the clip shown in FIG. 34.

DESCRIPTION OF PREFERRED EMBODIMENTS

Figure 1:
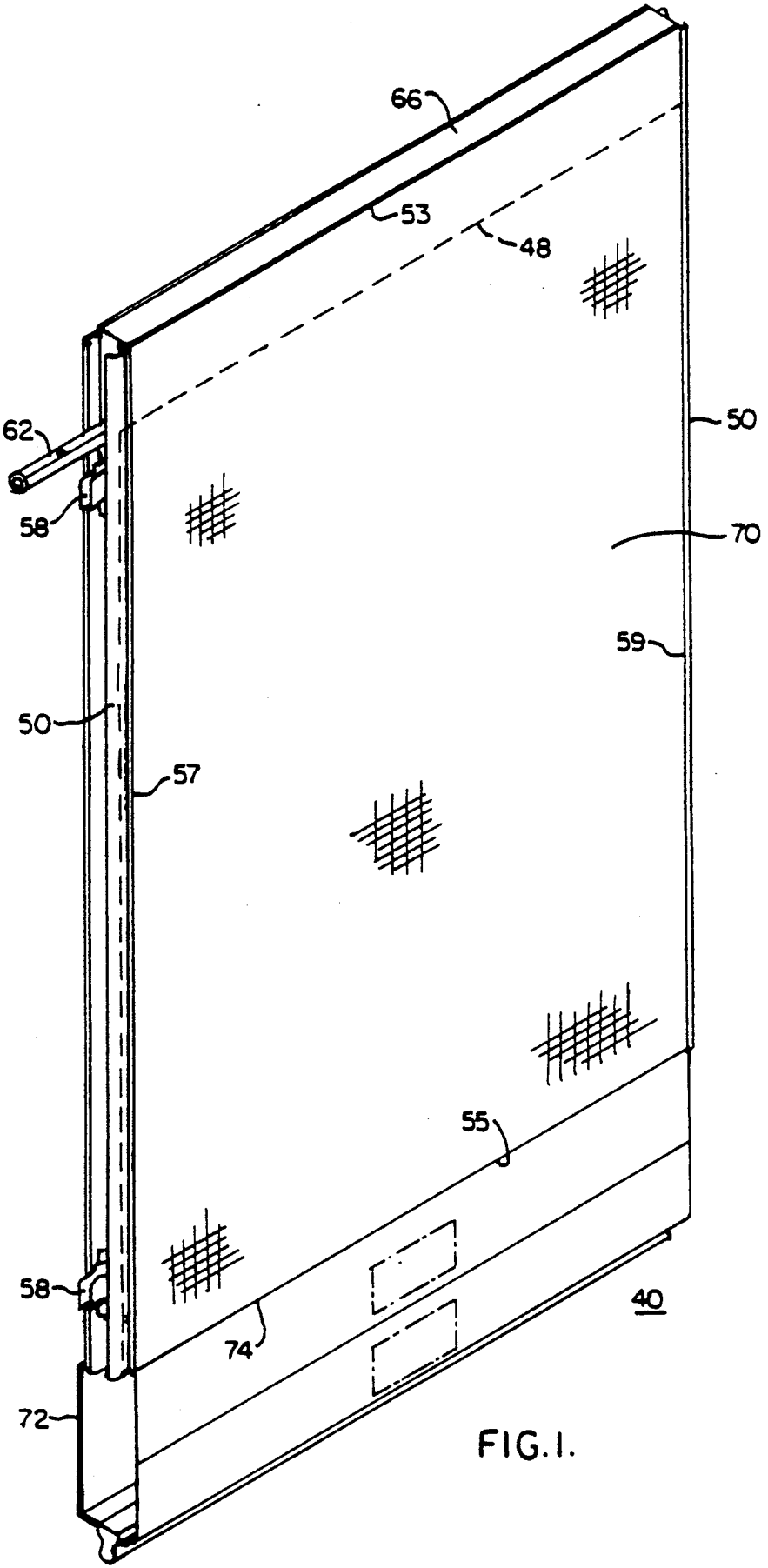
FIG. 1 is a perspective view of a panel constructed according to the teachings of the invention.
Figure 2:
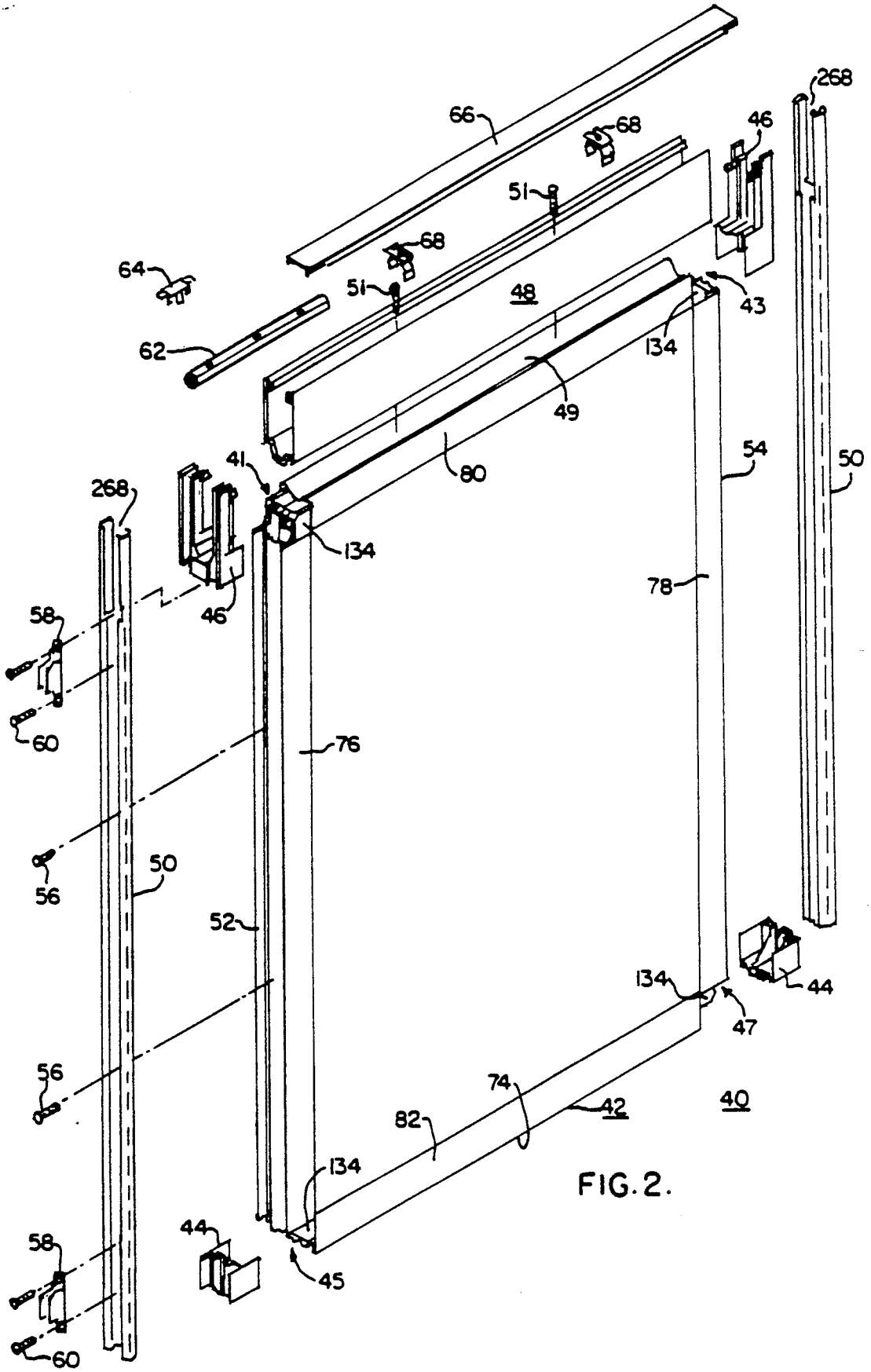
FIG. 2 is a partially exploded perspective view of the panel shown in FIG. 1, except without fabric outer panel coverings, and without an electrical raceway at the panel base.

Referring now to the drawings, and to FIGS. 1 and 2 in particular, there is shown in perspective in FIG. 1 a panel 40 which is constructed according to the teachings of the invention. FIG. 2 illustrates panel 40 in a partially exploded perspective view. Panel 40, as best shown in FIG. 2, includes a metallic frame 42 having first and second upper corners 41 and 43 and first and second lower corners 45 and 47; lower plastic frame corners 44; upper plastic frame corners 46; an upper wire trough 48 secured to an upper edge 49 of frame 40 via fasteners 5!; slotted standards 50 secured to first and second vertically extending lateral frame edges 52 and 54 via fasteners 56; support hooks 58 secured to slotted standards 50 via fasteners 60; a panel-to-panel spanner 62, illustrated for joining two adjacent panels in a straight line; a post cap 64; and a panel cap 66 which is removably attached to the top of wire trough 48 via clip members 68. As shown in FIG. 1, panel 40 also includes an outer covering 70 disposed on each of the opposite major flat surfaces thereof, and a raceway 72 fixed to a lower edge 74 of frame 42. Covering 70 has upper and lower edges 53 and 55 secured to the wire trough 48 and bottom portion of frame 42, respectively, and first and second side edges 57 and 59 secured to side portions of frame 42.

The raceway 72 is described in detail and claimed in concurrently filed application Serial No. 07/523,776, entitled "Space Dividing Partition System Having An Electrical Raceway And Method Of Constructing Same", which application is assigned to the same assignee as the present application.

A panel-to-post connector system, parts of which are shown in various FIGS. of the present application, is described in detail and claimed in concurrently filed application Serial No. 07/523,773, entitled "Office Space Dividing System", which application is assigned to the same assignee as the present application.

Figure 3:
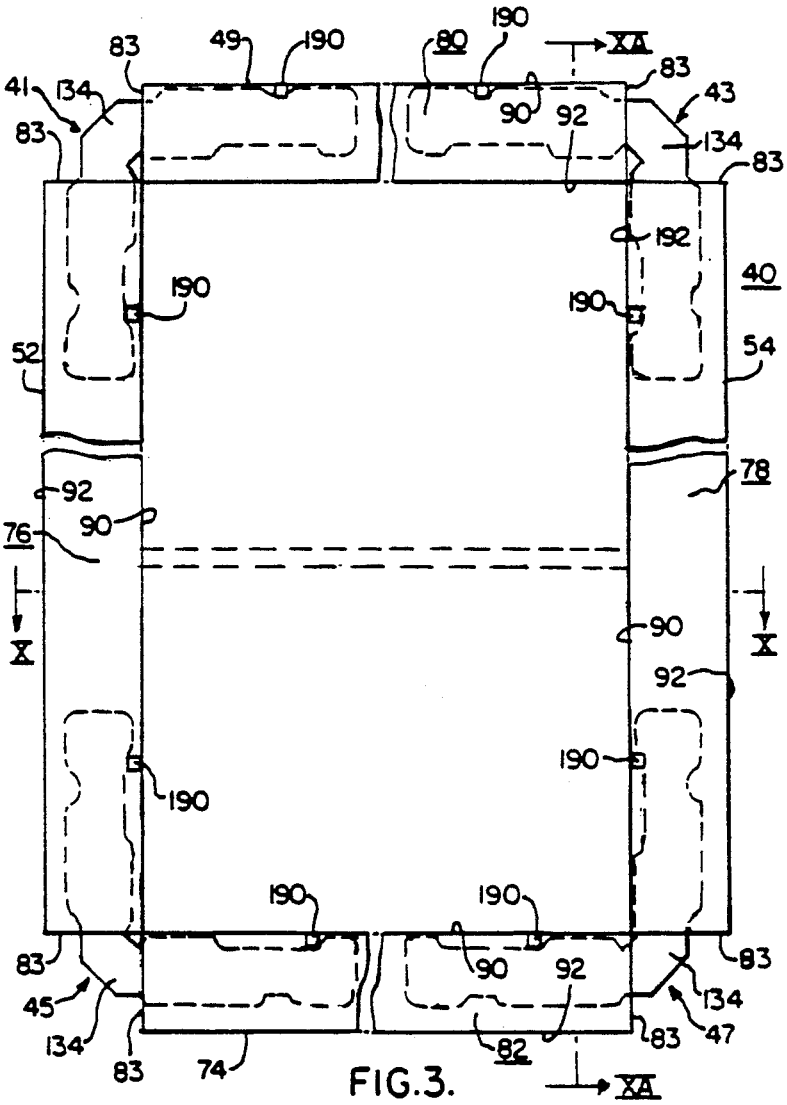
FIG. 3 is an elevational view of a panel frame shown in FIG. 2.

Referring now to FIG. 3, frame 40 is constructed of first and second vertical stiles 76 and 78 and upper and lower rails 80 and 82. Each of the frame elements 76, 78, 80 and 82 are formed by making square or 90 degree cuts from the same tubular metallic stock to form square cut ends 83 which define openings 85, with FIG. 4 being an enlarged end view of one of the frame elements, which for purposes of example will be assumed to be the first stile 76. Stile 76 is preferably roll formed from a steel sheet member, and welded at 84. Stile 76 is generally rectangular in cross section, having four sides, such as first and second opposite flat sides 86 and 88, and remaining opposite sides 90 and 92.

The broken lines 95 and 97 aligned with flat sides 86 and 88 represent front and back vertically oriented parallel planes which are disposed along each front and back major opposed surface of the frame 42 as defined by its rails and stiles, with flat sides 86 and 88 of the rails and stiles being respectively disposed in major planes 95 and 97.

Side 90 has a longitudinally extending, centrally located, relatively deep groove or channel 93. Channel 93 has a centrally located bottom or bight portion 94, and outwardly flared leg portions 96 and 98. Leg portion 96 has first and second bends 100 and 102 just prior to joining flat side 86, and leg portion 98 has similar first and second bends 104 and 106 just prior to joining flat side 88. These bends form open-sided pockets 108 and 110 adjacent to internal surfaces 112 and 114 of sides 86 and 88, for purposes which will be hereinafter explained.

Side 92 is folded sharply inward adjacent to sides 86 and 88, forming portions 116 and 118 which lie closely adjacent to inner surfaces 112 and 114, respectively. Portions 116 and 118 terminate in right angle inwardly directed bends which form bottom portions 120 and 122 of spline grooves 124 and 126. The bottom portions 120 and 122 continue via right angle, outwardly directed bends into portions 128 and 130 which complete the spline grooves 124 and 126. The spline grooves 124 and 126 receive spline beads 127, shown in FIG. 10, Which hold the edges 53, 55, 57 and 59 of the outer fabric coverings 70, when coverings 70 are applied to the major opposed sides of panel 40. An outwardly directed, corrugated central portion 132 joins portions 128 and 130, which portion adds strength to the frame elements via the corrugations, as well as by directing side 92 in the same direction as side 90, to prevent narrowing of the frame elements.

Figure 5:
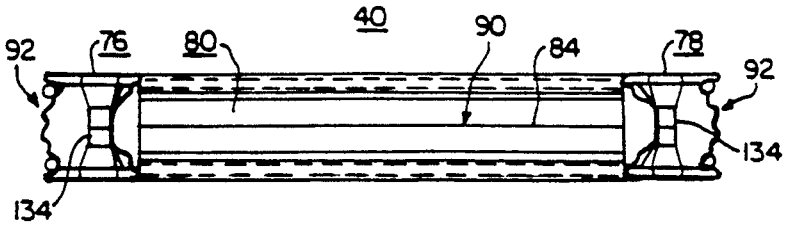
FIG. 5 is a top view of the frame shown in FIG. 3.
Figure 7:
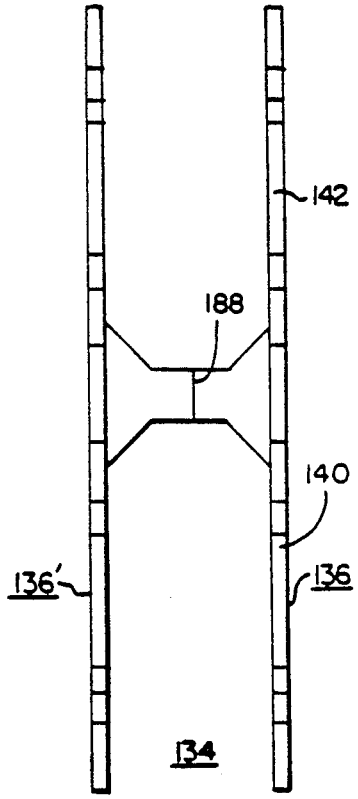
FIG. 7 is an end view of the right angle corner joining member shown in FIG. 6.
Figure 8:
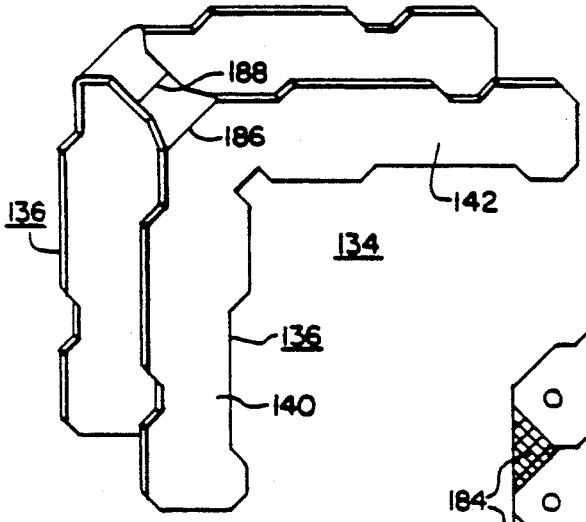
FIG. 8 is a perspective view of the right angle corner joining member shown in FIG. 6.

Returning to FIG. 3, and also referring to FIG. 5, which is a top view of panel 40, panel 40 is rigidly held together with right angle metallic joining means in the form of four similar right angle joining and reinforcing members 134. Right angle joining member 134 is shown in side elevations in FIG. 6, in an edge view looking at the outer corner in FIG. 7, and in a perspective view in FIG. 8. Right angle member 134 is constructed of two identical flat right angle portions 136 and 36', which are joined together, such as by welding, with FIG. 9 illustrating a preferred embodiment for stamping right angle portions 136 from a flat sheet 138 of metal, such as steel.

Figure 6:
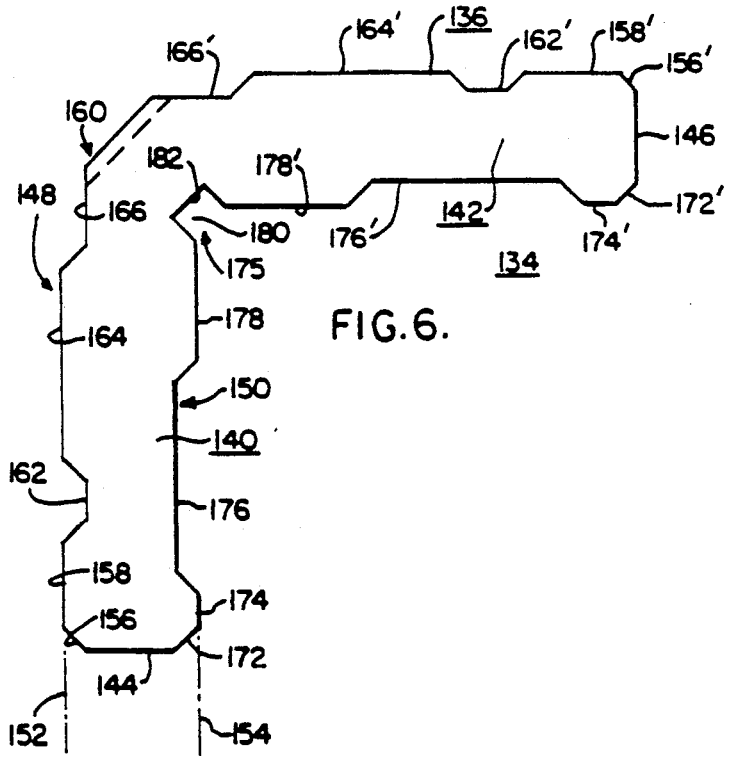
FIG. 6 is a side elevational view of a right angle corner joining member used to interconnect the stiles and rails of the frame shown in FIG. 3.
Figure 9:
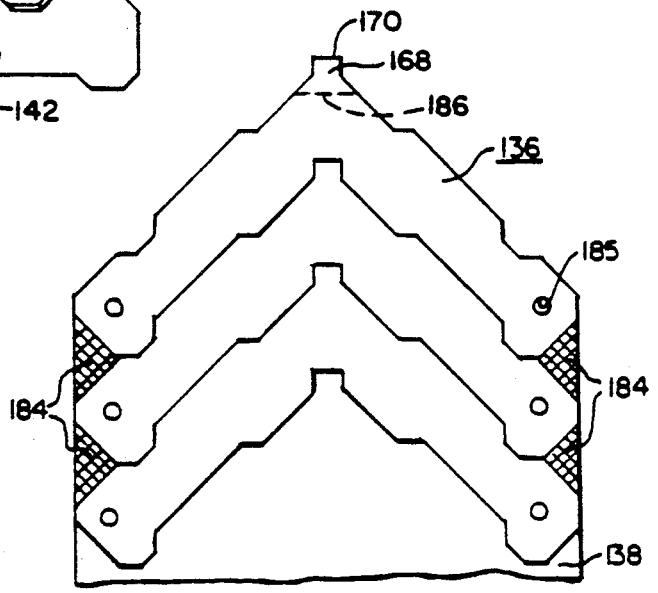
FIG. 9 illustrates a low scrap method of stamping the elements which make up the right angle corner joining member shown in FIGS. 6, 7 and 8.

More specifically, with reference more particularly to FIGS. 6 and 9, each flat right angle portion 136 has first and second legs 140 and 142, which have ends !44 and 146, respectively. Right angle portion 136 has outer and inner edges 148 and 150, respectively, which define predetermined outer and inner profiles which extend between ends 144 and 146.

End 144 is oriented perpendicular to outer and inner parallel planes 152 and 154 shown in FIG. 6, with end 144 entering the outer edge 148 and outer plane 152 via a chamfered portion 156. Portion 156 joins a portion 158 which lies in and follows the outer plane 152 towards the outer corner 160 of right angle portion 136. Portion 158 enters a short, rather shallow indentation 162, with the outer edge 148 then returning to a portion 164 which again lies in and follows the outer plane 152. Portion 164 terminates in an indentation 166, which is similar in depth to indentation 162 but longer, with indentation 166 terminating at a tab portion 168, best shown in FIG. 9. Tab portion 168 has an outer surface 170 at its extreme end oriented at an angle of 45 degrees relative to outer plane 152.

End 144 enters the inner edge 150 and inner plane 154 via a chamfered portion 172. Portion 172 joins a portion 174 which lies in and follows the inner plane 154 towards the inner corner 175 of right angle portion 136. Portion 174 enters a relatively long, shallow indentation 176, with the outer profile then returning to a portion 178 which again lies in and follows the inner plane 154. Portion 178 terminates in an indentation 180, the bottom of which has a surface 182 oriented parallel to the outer surface 170 of tab 1 68, ie., at an angle of 45 degrees to inner plane 154.

The second leg 142 of right angle portion 136 has outer and inner edges having profiles identical to those just described for the first leg 140, with the outer profile terminating at tab 168 and the inner profile terminating at indentation 180, and thus leg 142 will not be described in detail. Like reference numerals, except with a prime mark, are used to indicate portions of leg 142 which are similar to those of leg 140.

It will be noted that the inner profile 150 of right angle portion 134 is identical to its outer profile 148, enabling right angle portions 136 to be stamped from metal sheet 138 with only the small amount of Waste indicated in the cross-hatched areas 184. An opening 185 may be provided in one or both of the legs 140 and 142, for tool indexing purposes.

Each flat right angle portion 136 is bent with a right angle bend along a bend line 186, shown in phantom in FIG. 9, such that the tab 168 extends perpendicularly outward from the remainder of right angle portion 136. Two right angle portions 136 are then welded together tab-to-tab, indicated at weld 188, with surfaces 170 butted against one another, to form the right angle joining member 134.

Returning to FIGS. 3 and 5, a right angle member 134 is press fit into adjoining rails and stiles to form each right angle corner of frame 42, with the spaced legs 142 extending into the spaced pockets 108 and 110 of upper rail 80, for example, and with spaced legs 140 entering like pockets 108 and 110 of stile 76. The chamfers 156 and 172 lead the ends of the legs into the pockets. The tooling which press fits the legs of the right angle joining member 134 into adjoining openings in the ends of the rails and stiles automatically sizes and squares the corners of the frame 42. Once the size and squareness is achieved, the tooling stakes the legs and stiles, indicated at 190, to maintain the dimensions and squared corners without welding and grinding.

When the right angle joining members 134 are press fit into the openings of the rails and stiles, a flat horizontal plane disposed across the inner facing sides or surfaces of the upper and lower rails 80 and 82 will be substantially aligned with the flat square cut ends 83 of the stiles 76 and 78, and in like manner, a flat vertical plane disposed across the inner facing sides or surfaces of the first and second stiles 76 and 78 will be substantially aligned with the flat square cut ends of the upper and lower rails 80 and 82.

Figure 10A:
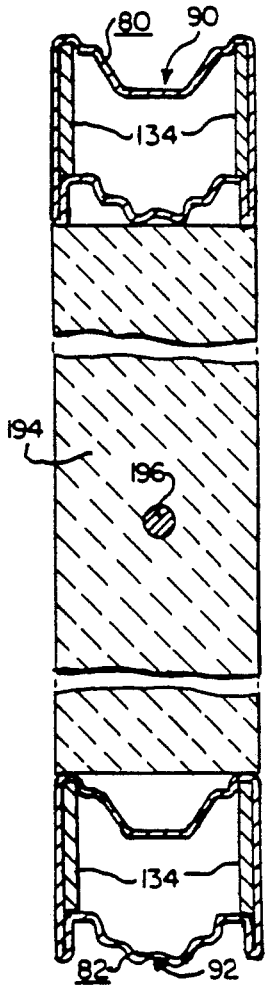
FIG. 10A is a vertical sectional view of the frame shown in FIG. 3, taken between and in the direction of arrows XA—XA.
Figure 10:
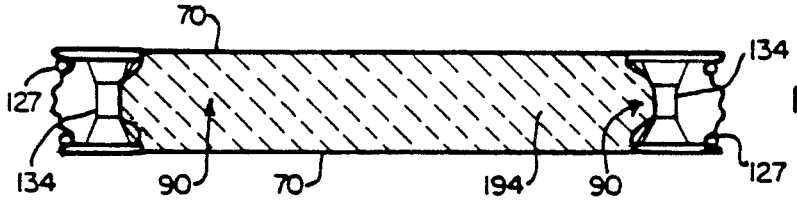
FIG. 10 is a horizontal sectional view of the frame shown in FIG. 3, taken between and in the direction of arrows X—X.

In a preferred embodiment, the central core of panel 40, within a window 192 defined by the assembled frame 42, is formed by a foamed-in-place gypsum material, as described in application Serial No. 06/872,053 filed June 6, 1986, entitled "Space-Dividing Wall Panel", now U.S. Pat. No. 4,949,518, which application is assigned to the same assignee as the present U.S. Pat. No. 4,949,518. FIGS. 10 and 10A are horizontal and vertical cross-sectional views through frame 42 illustrating a gypsum core 194 which has been foamed-in-place within the frame window 192, which views are respectively taken between and in the direction of arrows X—X and XA—XA in FIG. 3. FIG. 10 indicates how the channel sides 90 form pockets which firmly hold the gypsum within the frame window 192.

To prevent outward bowing of the stiles 76 and 78 when a foamed-in-place gypsum core 194 is used, at least one horizontally oriented metallic rod 196 is fixed to the inner sides 90 of stiles 76 and 78, such as by riveting or welding. Rod 196 is shown in FIGS. 3 and 10A. The number of metallic rods 196 used to prevent such bowing depends upon the height of frame 42.

Figure 12:
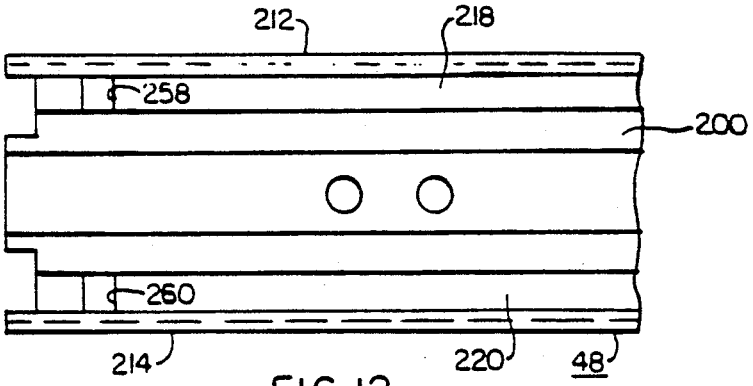
FIG. 12 is a plan view of the wire trough shown in FIG. 11, without the panel cap.
Figure 11:
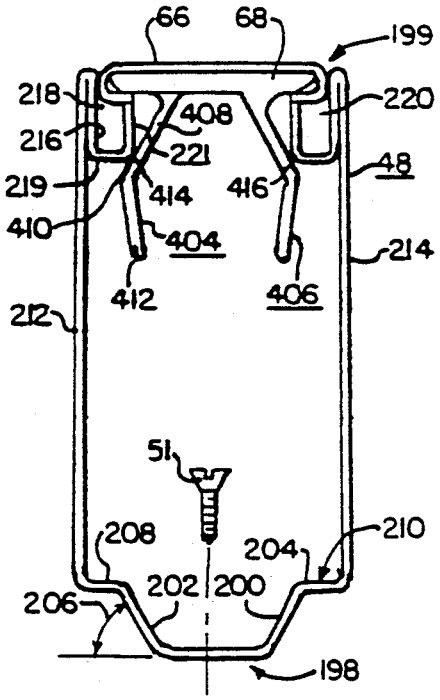
FIG. 11 is an end view of a wire trough and panel cap shown in FIG. 2.

FIG. 11 is an end view of wire trough 48, and FIG. 12 is a plan view thereof. Wire trough 48 is fixed to the upper rail 80. Trough 48 has bottom and top portions 198 and 199. Bottom portion 198 is configured to snugly nest in the longitudinally extending channel 93 of the upper rail 80, with channel 93, as hereinbefore stated, facing upwardly, instead of inwardly, toward the frame window 192. Trough bottom 198 includes a flat horizontally oriented bottom portion 200, upwardly and outwardly flaring sides 202 and 204 which are oriented at the same angle 206 with the horizontal bottom 200 as the orientation of sides 96 and 98 relative to the bottom or base 94 of channel 93. Sides 202 and 204 terminate in outwardly directed horizontal flanges 208 and 210, from which major side portions 212 and 214 extend vertically upward to the upper portion 199 of wire trough 48. Side portion 212 terminates in a sharp reverse bend which forms a first leg 216 of a U-shaped spline groove 218, which has a bight 219 and a second leg 221. The second leg 221 is slightly shorter than the first leg 216. In like manner, side 214 terminates in a spline groove 220.

Figure 14:
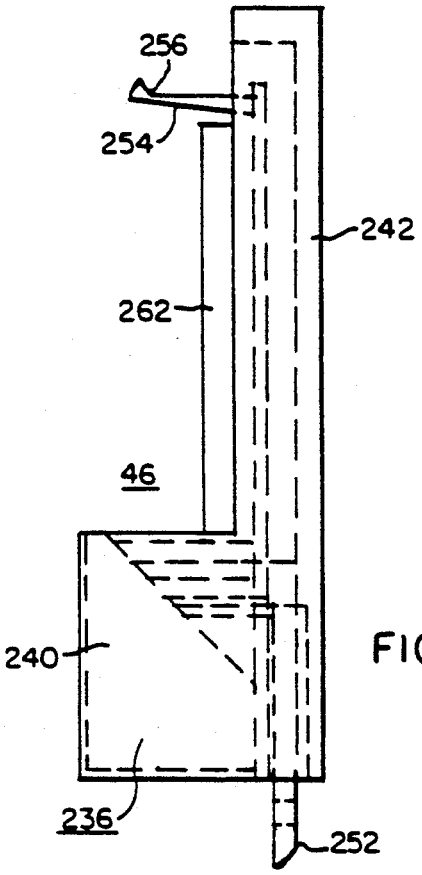
FIG. 14 is a side elevational view of an upper plastic frame corner shown in FIG. 2.

Since the panel 40 to this point of the description would have discontinuities at the outer corners which would appear through the fabric covering 70 applied to the major surfaces of panel 40, and since the spline grooves would also have discontinuities at the frame corners, lower and upper plastic members or frame corners 44 and 46 shown in FIG. 2 are provided. The lower plastic frame corner 44 is shown in perspective in FIG. 13, and the upper frame corner 46 is shown in side, end and cross-sectional views in FIGS. 14, 15 and 16, respectively.

More specifically, the lower plastic frame corner 44, which may be formed of Nylon 6/6, for example, is configured to fit over the outer corner 160 of the right angle joining member 134. Plastic frame corner 44 has first and second opposing flat sides 222 and 224 which have a substantially square configuration dimensioned to snugly fit the square lower corner voids of frame 42, smoothly continuing the flat vertical surfaces of the stiles 76 and 78 and lower rail 82 in the front and back major parallel planes 95 and 97 shown in FIG. 4.

Figure 13:
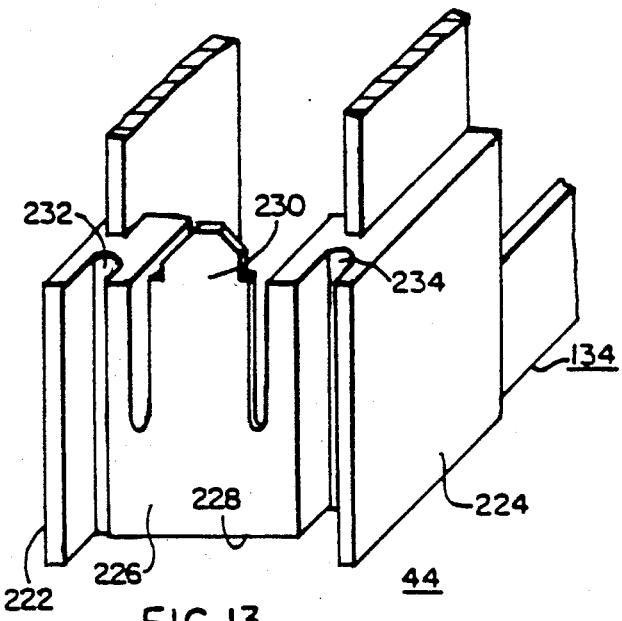
FIG. 13 is a perspective view of a lower plastic frame corner shown in FIG. 2.

In addition to continuing the flat vertically oriented parallel sides of the frame 42, the lower plastic frame corners 44 continue the outer perimeter of the stiles 76 and 78 and the lower rail 82, with FIG. 13 illustrating a side 226 of the plastic frame corner 44 which continues the perimeter of stile 76. A similar appearing side 228 faces downwardly, and is not shown in detail since it would have exactly the same appearance as side 226. Sides 226 and 228 have central resilient or flexible tabs, such as tab 230 on side 226, which are depressed or flexed slightly as they enter the openings 85 of stile 76 and lower rail 82, maintaining the lower corners 44 in the desired assembled positions. Spline grooves 232 and 234 on sides 226 and 228 continue the spline grooves 124 and 126 of the stiles 76 and 78 and lower rail 82.

The upper plastic frame corners 46, complete the upper frame corners adjacent the adjoining stiles and upper rail, and the upper frame corners 46 also complete the wire trough 48. Upper frame corner 46, which may also be formed of Nylon 6/6, for example, is also configured to fit over the outer corner 160 of the right angle joining member 134. Plastic frame corner 46 has first and second opposing flat sides 236 and 238 which have substantially square bottom portions 240 dimensioned to snugly fit the square upper corner voids of frame 42, smoothly continuing the flat vertical surfaces of the stiles 76 and 78 and upper rail 80 in the front and back major parallel planes 95 and 97. In addition to the square bottom portions 240, the opposing flat sides 236 and 238 have flat upper portions 242 which continue the outer surfaces of sides 212 and 214 of the wire trough 48 to the desired outer contour of panel 40. In other words, the longitudinal ends of wire trough 48 terminate before reaching the outer lateral vertical edges of panel 40, with each upper plastic corner 46 continuing the major flat vertical surfaces of the wire trough to an edge of panel 40.

Figure 15:
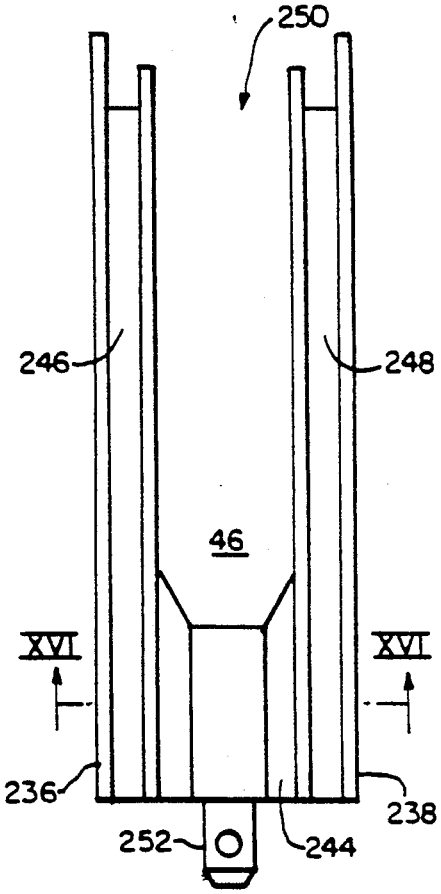
FIG. 15 is an end elevational view of the plastic frame corner shown in FIG. 14.
Figure 16:
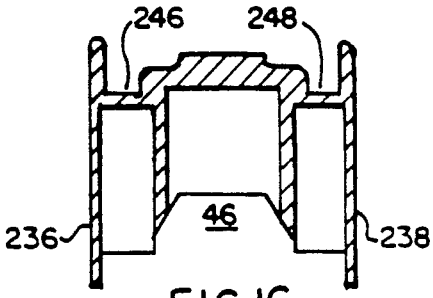
FIG. 16 is a cross-sectional view of the frame corner shown in FIG. 15, taken between and in the direction of arrows XVI—XVI.

In addition to continuing the flat vertically oriented parallel sides of the frame 42 and wire trough 48, the upper plastic frame corners 46 continue the outer perimeter of the stiles 76 and 78 and the wire trough 48, with FIGS. 15 and 16 illustrating a side 244 of the upper plastic frame corner 46 which continues the perimeter of stile 76. Side 244 has spline grooves 246 and 248 which continue the spline grooves 124 and 126 of the stiles, as well as the spline grooves 218 and 220 of the wire trough 48. As clearly shown in FIG. 15, upper plastic corner 46 has an opening 250 aligned with the end opening of wire trough 48, enabling wiring in the wire trough 48 to continue unobstructed from panel to panel.

The upper frame corner 46 is fixed in position by a depending tab portion 252 which may be secured, for example, by screw 60 when the hook portion 58 is attached to slotted standard 50. In addition to tab 252, upper frame corner 46 has a pair of horizontally spaced, outwardly extending resilient fingers 254 which are downwardly depressed by the lower surfaces of the bottom portions of the spline grooves 218 and 220, until reaching the desired assembled position, at which time, upwardly extending barbs 256 snap into openings 258 and 260 in such lower surfaces of the spline grooves 218 and 220, with the openings 258 and 260 being shown in FIG. 12. Upper frame corner 46 also has a pair of flanges 262 which snugly enter the end opening of wire trough 48. FIG. 16 is a cross sectional view through upper plastic frame corner 46, taken between and in the direction of arrows XVI—XVI in FIG. 15. A convenient assembly method includes the step of assembling the upper corners 46 with the wire trough 48 just prior to fixing the wire trough 48 to the upper edge of frame 42.

FIG. 17 is a fragmentary elevational view of panel 40 being joined to another panel 40' of like construction, in an office space dividing system 264 in which the panels 40 and 40 are supported by a post 266 having hook receiving means 267, ie, upper edges of flanges 269. The connector system which includes support hooks 58 and post 266 forms no part of the invention, and will not be described in detail. As stated earlier, the connector system is disclosed and claimed in the hereinbefore identified concurrently filed patent application.

The top of post 266 is approximately level with the top surface of horizontal wire-supporting bottom portion 200 of wire trough 48, while the slotted standards 50 continue to the top of the wire trough 48. The portions of the slotted standards 50 which would interfere with wiring proceeding from one wire trough 48 to the next is removed, as indicated at 268 in FIG. 2. Post covers snap on to post 266 to cover sides thereof which could support a panel 40, but which are unused in any particular office space dividing system arrangement, such as post cover 270. The top edge 272 of post cover 270 is substantially aligned with the top edges of the wire troughs 48 and slotted standards 50.

Figure 22:
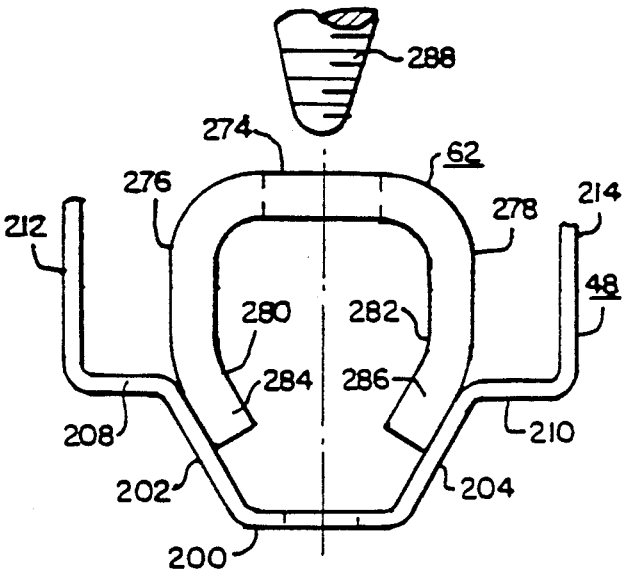
FIG. 22 is a fragmentary elevational end view which illustrates the installation of the spanner shown in FIG. 19 in the wire trough shown in FIG. 11.
Figure 19:
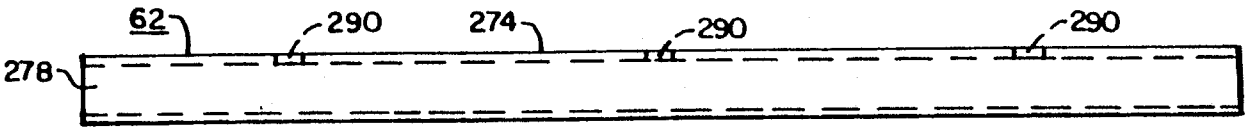
FIG. 19 is a side elevational view of a panel-to-panel spanner shown in FIGS. 2, 17 and 18, for connecting two panels in a straight line.
Figure 20:
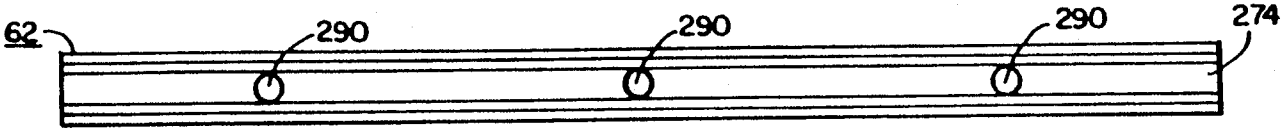
FIG. 20 is a plan view of the spanner shown in FIG. 19.
Figure 21:
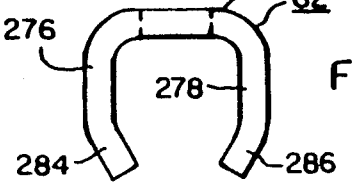
FIG. 21 is an end view of the spanner shown in FIG. 19.

In order to rigidize the office space dividing system 264, as broadly disclosed in U.S. Pat. No. 4,424,654, which patent is assigned to the same assignee as the present application, panel to panel spanners are used, such as the spanner 62 used to connect two in-line panels 40. Spanner 62 is shown in elevational, plan and end views in FIGS. 19, 20 and 21, respectively, and in an enlarged end view in FIG. 22. Spanner 62 takes advantage of the structural mass and rigidity of the wire troughs 48, upper rails 80, and of a metallic spanner configuration and structure which utilizes the wedge-shaped wire trough configuration to resist any tendency of connected panels to twist or move relative to one another.

More specifically, spanner 62 is formed from a high strength metal, such as 12 gauge hot rolled steel, into an elongated bar having an inverted, substantially U-shaped cross sectional configuration which includes a bight 274 and first and second depending legs 276 and 278. The lower portions of legs 276 and 278 are bent inwardly at bends 280 and 282 to form portions 284 and 286 which are angled at the same angle as sides 202 and 204 of wire trough 48. Thus, spanner 62 is disposed in the wire troughs 48 of two adjacent panels 40 and 40', and it is secured to the wire troughs and to the top of the intervening post 266 via suitable fasteners, such as by screws 288 which are disposed through openings 290 in the bight 274. The complementary sides of the wire trough and spanner create a wedging effect which, along with the large mass of metal at the top of the panel system provided by the wire trough 48, upper rail 80, and spanner 62, provides superior alignment forces which positively maintain the desired alignment of each panel supported by a post.

Figure 23:
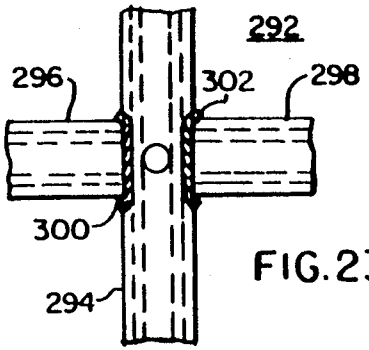
FIG. 23 is a fragmentary plan view of a spanner for a four-way intersection of four panels.

FIG. 23 is a fragmentary plan view of a spanner assembly 292 which may be used to join the wire troughs 48 and post 266 of four panels 40 at a four-way intersection of such panels. The same basic spanner construction is used to construct spanner assembly 292 as for the straight spanner 62. Spanner assembly 292 includes one relatively long straight section 294 having 90 degree cut ends, and two shorter straight sections 296 and 298, also having square cut ends. Square cut ends of sections 296 and 298 are welded to the midpoint of section 294, as indicated at welds 300 and 302.

Figure 25:
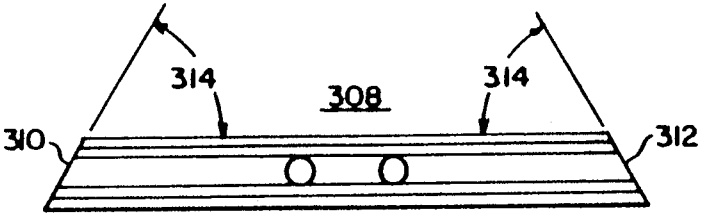
FIG. 25 is a plan view of one of the elements used to construct the spanner shown in FIG. 24.
Figure 24:
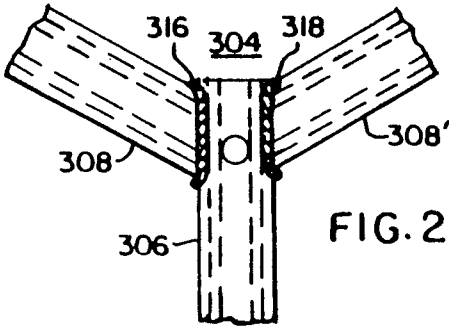
FIG. 24 is a fragmentary plan view of a spanner for a three-way 120 degree intersection of three panels.

FIG. 24 is a plan view of a spanner assembly 304 for three panels 40 joined in a three-way 120 degree intersection. Spanner assembly 304 includes a section 306 having square cut ends, and two sections 308 and 308', which may be of like construction, having at least one miter cut end. Section 308 is shown in a plan view in FIG. 25 having both ends 310 and 312 miter cut at an angle 314 of 60 degrees. Thus, the spanner section shown in FIG. 25 may be used for either of the sections 308 or 308', and only two different part configurations need be made and stocked to construct spanner assembly 304. The miter cut ends 310 and 312 of sections 308 and 308' are welded to opposite sides of one end of spanner section 306, as indicated at welds 316 and 318.

Figure 26:
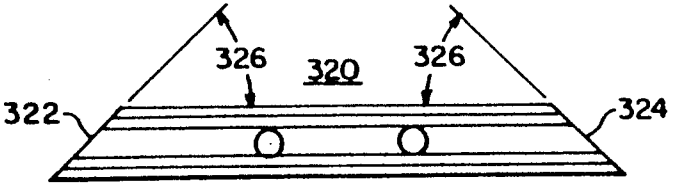
FIG. 26 is a plan view of an element which may be used in place of the mitered elements shown in FIG. 24 to construct a three-intersection of three panels having one 90 degree angle and two 135 degree angles between the three panels.

To construct a spanner assembly for a three-way panel intersection wherein one angle between panels is 90 degrees and two angles are 135 degrees, a spanner section 320 shown in FIG. 26 would be used in place of spanner sections 308. Spanner section 320 has two miter cut ends 322 and 324 which are cut at an angle of 45 degrees, indicated at 326. The spanner assembly for a three-way 90/135/135 intersection would appear similar to spanner assembly 304 shown in FIG. 24 for a 120 degree three-way intersection, except for the angles between spanner sections, and thus it is unnecessary to illustrate a separate spanner assembly for the 90/135/135 spanner.

Figure 27:
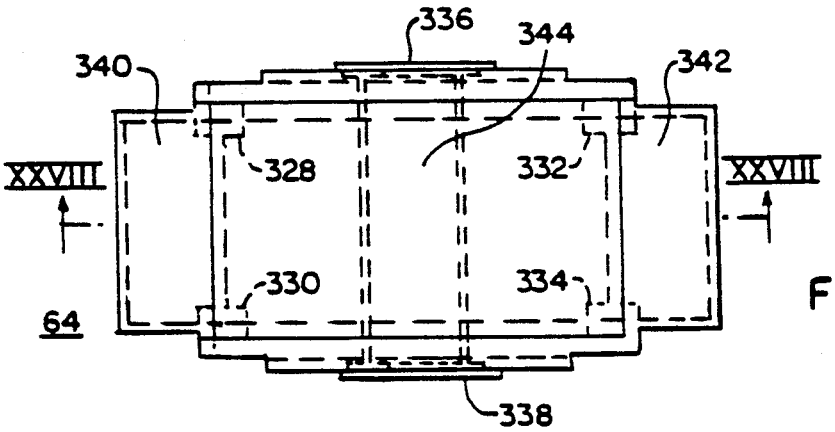
FIG. 27 is a plan view of a post cap for a two-way straight intersection between two panels.
Figure 28:
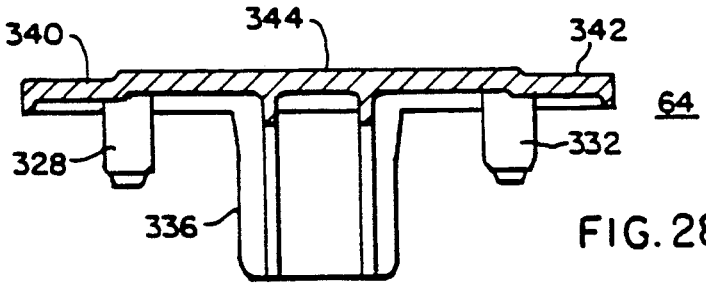
FIG. 28 is a cross-sectional view of the post cap shown in FIG. 28, taken between and in the direction of arrows XXVIII—XXVIII.

FIGS. 27 and 28 are plan and sectional views of post cap 64 shown in FIG. 2, for a two way intersection of panels 40. Post cap 64, which may be made of a suitable plastic, such as a polycarbonate, covers the top of post 266. Post cap 64 has three locating portions: (1) first depending leg means for positioning relative to the slotted standards 50, (2) second depending leg means for positioning relative to any post covers 270, and (3) third locating means in the form of outwardly directed, horizontal projections which underlie each panel cap 66 which approaches the panel intersection.

More specifically, with a two-way panel intersection, there are four depending legs 328, 330, 332, and 334 for locating from the slotted standards 50. Legs 328 and 330 enter the top of a slotted standard 50 associated with one panel 40, and legs 332 and 334 enter the top of the slotted standard 50 associated with the other panel 40'. Since there would be two post covers 270 with a two-way intersection, ie., two unused panel positions, there are two depending legs 336 and 338 which engage the back surface of each post cover. Since two panels join in a two-way intersection, two opposite, horizontally extending portions 340 and 342 are provided, the top surfaces of which are recessed below the surface of a center portion 44 of the post cap 64. The recessed depth is the same as the thickness dimension of a metallic panel cap, when the panel cap 66 is formed of metal, as will be hereinafter described.

Other post caps for use with posts which have an unused panel position include post caps for a single panel joined to a post, and post caps for three panels joined to a post in a T-configuration. The post caps for these arrangements would have the same three locating functions, and need not be described in detail, eg., they would have a pair of depending legs for each slotted standard, a depending leg for each post cover, and a horizontal locating portion for each panel cap associated with a panel supported by the post.

Figure 29:
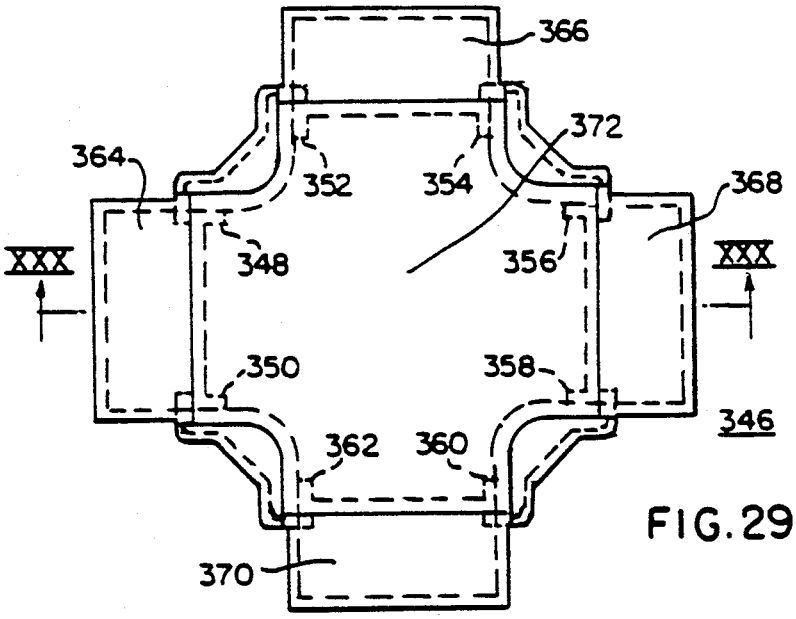
FIG. 29 is a plan view of a post cap for a four-way intersection between four panels.
Figure 30:
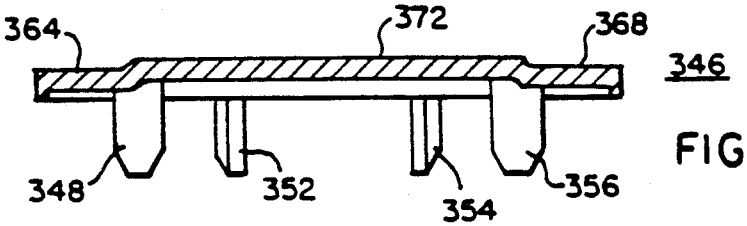
FIG. 30 is a cross-sectional view of the post cap shown in FIG. 29, taken between and in the direction of arrows XXX—XXX.

FIGS. 29 and 30 are plan and sectional views of a post cap 346 for a post in which there are no unused panel positions, such as the four-way intersection illustrated. Other panel connections which have no unused panel positions include the three-way 120 degree intersection, and the three-way 90/135/135 intersection. Since the principles used to construct such post caps are the same for each configuration having no unused panel positions, only the post cap 346 for a four-way panel intersection is shown.

More specifically, when no unused panel positions are present, there will be no post cover disposed on an unused panel position, and thus the post cap does not have a depending leg portion for locating from a post cover. Thus, for the four-way intersection, post cap 346 includes a pair of depending legs for each of the four slotted standards 50, and a horizontal locating portion for each of the four panels joined to the associated post. For example, depending legs 348 and 350 enter one slotted standard 50, legs 352 and 354 enter another, legs 356 and 358 enter still another, and legs 360 and 362 enter the remaining slotted standard 50. Four horizontal alignment portions 364, 366, 368 and 370 are provided to underlie the four panel caps 66 which will extend into the area of the support post 266. The upper surfaces of the horizontal alignment portions are recessed below the surface 372 of the center portion of post cap 346.

FIGS. 31, 32 and 33 are side elevational, bottom and end views, respectively, of panel cap 66 shown in FIGS. 1 and 2, illustrating a metallic embodiment thereof. Panel cap 66 is formed from a sheet of metal into a substantially C-shaped configuration, having a bight 374, and first and second depending leg portions 376 and 378 which respectively terminate in inwardly turned flanges 380 and 382. The inwardly turned flanges 380 and 382 are cut away at the ends of the panel cap 66, as indicated at 384 and 386, to allow the ends of the panel cap 66 to overlie the horizontally directed alignment portions of the post cap, such as the horizontal alignment portions 340 and 342 of post cap 64 shown in FIG. 27. The shorter inwardly disposed legs 221 of the wire trough 48 which define one side of spline grooves 218 and 220 permit the upper surface of panel cap 66 to be substantially flush with the top edges of the wire trough 48.

FIGS. 34 and 35 are elevational and plan views, respectively, of mounting clip 68 shown in FIG. 2, for attaching panel cap 66 to the wire trough 48. Clip 68 is formed of a suitable plastic, such as an injection molded polypropylene, and it includes a top portion 388 which has a similar configuration at opposite longitudinal ends 390 and 392. End 390 includes a relatively thin, resilient leg portion 394, and a thick relatively non-resilient leg portion 396. Leg portion 396 includes a side portion 398 which extends inwardly to the root 400 of leg portion 394. Portion 398 may be curved, as indicted, or straight, as desired. The important thing is to provide space for leg portion 394 to flex towards leg portion 396. Side 392 is of like construction, but having a resilient leg portion 394' at the diagonally opposite corner of the clip, which places leg portion 396' at the diagonally opposite corner to leg portion 396.

In the unstressed configuration of clip 68 shown in FIG. 35, the ends 401 and 401' of leg portions 394 and 394', and the ends 403 and 403, of leg portions 396 and 396' form four spaced mounting points which, when imaginary lines are drawn from one to the next, form a rectangular outline.

To fix mounting clip 68 to panel cap 66, clip 68 is placed within the C-shaped configuration of the panel cap 66 such that the longitudinal axis 405 of the clip 68 is substantially aligned with the longitudinal axis 407 of panel cap 66. Clip 68 is then turned or twisted one-quarter turn about vertical axis 409, in the direction of arrow 402. Legs 394 and 394' will be inwardly flexed by leg portions 376 and 378 of the panel cap 66. Thus, mounting points 401 and 401' are effectively moved out of their normal positions and they do not provide their locating and mounting function during clip assembly. Thus, there is relatively little resistance to rotational movement of clip 68 during the one quarter installation turn. Once clip 68 reaches a point where its longitudinal axis 405 is perpendicular to the longitudinal axis 407 of the panel cap 66, legs 401 and 401' move back to their unbiased positions. Now all four mounting points 401, 401', 403 and 403' become functional, to firmly hold clip 68 in the assembled position within the panel cap 66.

Attempting to turn clip 68 in either rotational direction after assembly results in trying to force two diagonally opposite leg ends perpendicularly into the legs 376 and 378 of panel cap 66, preventing removal. The only way clip may be easily removed is to slide it to an end of the panel cap 66. It may also be removed by the difficult task of manually deflecting both legs 394 and 394' inwardly at the same time with a suitable tool, and then turning the clip.

Clip 68 further includes first and second resilient depending legs 404 and 406. Leg 404 includes an outwardly directed upper portion 408, a bend or knee 410, and an inwardly directed portion 412. Leg 406 is of similar construction. When panel cap 66, with clips 68 secured thereto, is moved downwardly towards its seated position on top of wire trough 48, the inwardly converging legs are initially between the walls 221 of the spline grooves 218 and 220, and then the spline grooves contact the lower portions 412 and 412' to bend the legs 404 and 406 inwardly towards one another. As the seated position of panel cap 66 is approached, the knees 410 and 410' pass the lower corners 414 and 416 of the spline groove structures 218 and 220, allowing the legs 404 and 406 to start to return to their unbiased configurations, providing a downwardly directed bias which firmly holds the mounting clips 68 and panel cap 66 in the desired position substantially flush with the top of the wire trough 48.

Prying the panel cap 66 upwardly will reverse the procedure, reaching a point where the panel cap 66 will be released from the spline groove structures 218 and 220 which holds the clips 68 with the downwardly directed force when the knees 410 and 410' are below the spline groove corners 414 and 416. Mounting clip 68 also has a fastener opening 414, permitting clip 68 to be screwed to the underside of a panel cap which is made of wood or some other non-metallic material.

We claim:

1. An office space dividing system, including at least one rectangular panel having a frame which includes first and second stiles and upper and lower rails arranged to define two upper and two lower corners, with the first and second stiles and upper and lower rails having substantially flat front and back sides disposed in common front and back planes, respectively, and inner and outer facing sides which extend between the front and back planes, characterized by:

the first and second stiles and upper and lower rails being constructed of tubular members having the same cross-sectional configuration, and having square cut ends having edges which define openings to the tubular members, said first and second stiles and upper and lower rails being arranged such that the inner side of each rail is substantially aligned with an end of each stile, and the inner side of each stile is substantially aligned with an end of each rail, to provide adjoining obstructed openings at each of the upper and lower corners, and including right-angle metallic joining means linking the rails and stiles at each of the upper and lower corners via the adjoining openings, with the rails and stiles being adjusted relative to the right-angle metallic joining means to provide square upper and lower corners, said right angle joining means including first and second spaced identical right angle members formed from a flat metallic sheet, with each having a centrally located joining tab bent orthogonally towards, and joined to, the joining tab of the other.

2. The office space dividing system of claim 1 wherein the rails and stiles are staked to the right angle joining means to retain the square upper and lower corners.

3. The office space dividing system of claim 1 wherein each right angle member has inner and outer edges which define indentations which facilitate staking, with the outer edge being complementary to the inner edge, permitting the right angle members to be stamped from a flat metallic sheet with substantially no waste.

4. The office space dividing system of claim 1 ; wherein the inner facing sides of the first and second stiles and the upper and lower rails collectively define a window, with said window being occupied by a foamed-in-place gypsum core.

5. The office space dividing system of claim 2 wherein the inner facing sides of the first and second stiles and upper and lower rails have at least one longitudinal extending channel which functions to hold the desired position of the gypsum core within the window.

6. The office space dividing system of claim 1 including at least one metallic rod extending between and fixed to the inner facing sides of the first and second stiles, to prevent outward bowing of the first and second stiles.

7. The office space dividing system of claim 6 wherein the inner facing sides of the first and second stiles and the upper and lower rails collectively define a window, with said window being occupied by a foamed-in-place gypsum core.

8. An office space dividing system, including at least one rectangular panel having a frame which includes first and second stiles and upper and lower rails arranged to define two upper and two lower corners, with the first and second stiles and upper and lower rails having substantially flat front and back sides disposed in common front and back planes, respectively, and inner and outer facing sides which extend between the front and back planes, characterized by:

the first and second stiles and upper and lower rails being constructed of tubular members having the same cross-sectional configuration, and having square cut ends having edges which define openings to the tubular members, said first and second stiles and upper and lower rails being arranged such that the inner side of each rail is substantially aligned with an end of each stile, and the inner side of each stile is substantially aligned with an end of each rial, to provide adjoining unobstructed openings at each of the upper and lower corners, and including right-angle metallic joining means linking the rails and stiles at each of the upper and lower corners via the adjoining openings, with the rials and stiles being adjusted relative to the right-angle metallic joining means to provide square upper and lower corners, said inner facing sides of the identically configured first and second stiles and lower rail having a centrally located channel, and the outer facing sides of the first and second stiles and lower rail having first and second spaced grooves adjacent to the substantially flat front and back sides, with the identically configured top rail being inverted relative to the position of the lower rail such that the inner facing side has said first and second spaced grooves and the outer facing side has said centrally located channel.

9. The office space dividing system of claim 8 wherein the inner facing sides of the first and second stiles and the upper and lower rails collectively define a window, with said window being occupied by a foamed-in-place gypsum core which is held within the window by the centrally located channels of the first and second stiles and lower rail, and by the first and second spaced grooves of the upper rail.

10. The office space dividing system of claim 1 including a wire trough fixed to the upper rail, with the wire trough having a bottom portion configured complementary to the central channel in the outer facing side of the upper rail.

11. The office space dividing system of claim 10 including first and second sheets of panel coverings each having upper, lower and side edges, and first and second spline beads, and wherein the first and second spaced grooves in the outwardly facing sides of the first and second stiles and lower rail function as spline grooves for respectively receiving said first and second spline beads which hold the side and lower edges of said panel coverings, and wherein the wire trough has an upper portion which has first and second spaced grooves which function as spline grooves which receive the first and second spline beads to hold the upper edges of the panel coverings.

12. The office space dividing system of claim 11 including first and second upper and first and second lower corner members removably fixed to the frame, with said first and second upper corner members having first and second spaced grooves which continue the first and second grooves in the first and second stiles and the first and second grooves in the wire trough, and with the first and second lower corner members having first and second spaced grooves which continue the first and second grooves in the first and second stiles and the first and second grooves in the lower rail.

13. The office space dividing system of claim 12 wherein the first and second upper and first and second lower corner members each have front and back flat surfaces respectively disposed in the common front and back planes.

14. The office space dividing system of claim 12 including a vertically extending support post having hook receiving means, and including hook means on the at least one rectangular panel engaging the hook receiving means of said support post, and including a second rectangular panel supported by said support post, with said second rectangular panel including a wire trough having a bottom portion configured the same as and aligned with the bottom portion of the wire trough of the at least one rectangular panel, and including a metallic spanner disposed within and fixed to the bottom portions of the wire troughs of the at least one and said second rectangular panels.

15. The office space dividing system of claim 14 including means additionally fixing the metallic spanner to the support post.

16. The office space dividing system of claim 14 wherein the bottom portions of the troughs have outwardly flared sides, and wherein the metallic spanner has a substantially inverted U-shaped cross-sectional configuration having depending legs which include inwardly angled portions which rest against and wedge within the outwardly flared sides of the wire troughs.

17. The office space dividing system of claim 10 including an elongated panel cap removably attached to, and substantially flush with, the top portion of the wire trough.

18. The office space dividing system of claim 17 wherein the elongated panel cap has a substantially C-shaped configuration which includes a bight, depending leg portions, and inwardly turned flange portions, and including a clip member attached to the panel cap, said clip member having first and second longitudinal ends, and first and second spaced mounting points at each end which are closely adjacent to the depending leg portions of the panel cap, with a mounting point at each end being provided by first and second horizontally oriented resilient leg portions, said resilient leg portions being constructed to flex during assembly with the panel cap such that their associated mounting points are not effective until the desired assembled position is achieved, at which point they become functional to cooperate with the other mounting points to resist disassembly from the panel cap in response to forces which tend to rotate the clip member in either rotational direction.

19. The office space dividing system of claim 18 wherein the clip member has first and second resiliently bendable depending legs which include knee portions which are biased inwardly by first and second predetermined portions of the wire trough, with the knee portions being below said first and second predetermined portions such that the biasing force is in a direction which resists disassembly, to firmly but releasably hold the elongated panel cap against first and second predetermined portions of the wire trough.

20. The office space dividing system of claim 10 including a vertically extending support post having hook receiving means, and including hook means on the at least one rectangular panel engaging the hook receiving means of said support post, with said hook means including a slotted standard and at least upper and lower hooks fixed thereto, a post cap which includes a depending alignment portion which engages the slotted standard and a horizontal alignment portion, and an elongated panel cap removably attached to, and substantially flush with, a top portion of the wire trough, with said panel cap overlying the horizontal alignment portion of the post cap.

21. The office space dividing system of claim 20 including post cover means disposed to cover at least one vertical side of the post, and having an upper end which terminates adjacent to the post cap, and wherein the post cap includes an additional depending alignment portion which engages the post cover means adjacent to said upper end.

22. An office space dividing system, including a post, and at least two rectangular panels supported by the post, with each panel having a frame having an upper rail, characterized by:

said upper rail having an upwardly facing surface which defines a channel having a bight and upwardly extending, outwardly flared sides, a wire trough fixed to the upper rail of each panel, with the wire trough having a bottom portion nested in the channel defied by the top rail, including a bottom having outwardly flared sides, including a panel-to-panel spanner fixed to the wire troughs of both of the at least two panels, and to the post, with the spanner having a cross sectional configuration in the shape of an inverted U, including depending legs having portions which are bent inwardly to nest and wedge within the outwardly flared sides of the bottom of the wire trough.

23. The office space dividing system of claim 22 wherein the wire trough has an upper portion which has first and second spaced grooves which function as spline grooves.

24. The office space dividing system of claim 22 including an elongated panel cap removably attached to, and substantially flush with, the top portion of the wire trough.

25. The office space dividing system of claim 24 wherein the elongated panel cap has a substantially C-shaped configuration which includes a bight, depending leg portions, and inwardly turned flange portions, and including a clip member attached to the panel cap, said clip member having first and second longitudinal ends, and first and second spaced mounting points at each end which are closely adjacent to the depending leg portions of the panel cap, with a mounting point at each end being provided by first and second horizontally oriented resilient leg portions, said resilient leg portions being constructed to flex during assembly with the panel cap such that their associated mounting points are not effective until the desired assembled position is achieved, at which point they become functional to cooperate with the other mounting points to resist disassembly from the panel cap in response to force which tend to rotate the clip member in either rotational direction.

26. The office space dividing system of claim 25 wherein the clip member has first and second resiliently bendable depending legs which include knee portions which are biased inwardly by first and second predetermined portions of the wire trough, with the knee portions being below said first and second predetermined portions such that the biasing force is in a direction which resists disassembly, to firmly but releasably hold the elongated panel cap against first and second predetermined portions of the wire trough.

27. The office space dividing system of claim 22 wherein the post includes hook receiving means, and including hook means on the at least two rectangular panels engaging the hook receiving means of said support post, with said hook means including a slotted standard and at least upper and lower hooks fixed thereto, a post cap which includes a depending alignment portion which engages the slotted standard and a horizontal alignment portion, and an elongated panel cap removably attached to, and substantially flush with, the top portion of the wire trough, with said panel cap overlying the horizontal alignment portion of the post cap.

28. The office space dividing system of claim 27 including post cover means disposed to cover at least one vertical side of the post, and having an upper end which terminates adjacent to the post cap, and wherien the post cap includes an additional depending alignment portion which engages the post cover means adjacent to said upper end.

29. An office space dividing system including at least one rectangular panel having an upper edge, and an elongated panel cap on the upper edge, characterized by:

the elongated panel cap having a substantially C-shaped configuration which includes a bight, depending leg portions, and inwardly turned flange portions, and a clip member attached to the panel cap which removable connects the panel cap to the upper edge of the panel, said clip member having a vertical axis, about which the clip member is rotated during assembly with said panel cap, said clip member having a substantially flat, upper, horizontally oriented surface having first and second longitudinal ends, with the flat upper surface, which is disposed at right angles to said vertical axis, being disposed closely adjacent to the bight of said panel cap, between said depending leg portions, said clip member further having first and second spaced mounting points at each of said first and second longitudinal ends which are closely adjacent to the depending leg portions of the panel cap, with a mounting point at each longitudinal end being provided by first and second horizontally oriented resilient leg portions which extend horizontally outward from said clip member in opposite directions and respectively terminate at said first and second longitudinal ends, said resilient leg portions being constructed to flex during assembly with the panel cap, during which the clip member is rotated 90 degrees about said vertical axis, such that the mounting points associated with the first and second resilient leg portions are not effective until the desired assembled position is achieved, at which point they become functional by returning to their un-flexed configurations to cooperate with the other mounting point at each longitudinal end to resist disassembly from the panel cap in response to forces which tend to rotate the clip member in either rotational direction about said vertical axis.

30. The office space dividing system of claim 29 wherein the upper edge of the panel has a channel shaped recess, and wherein the clip member has first and second resiliently bendable depending legs which include knee portions which are biased inwardly by first and second predetermined portions of the recess, with the knee portions being below said first and second predetermined portions such that the biasing force is in a direction which resists disassembly, to firmly but releasably hold the elongated panel cap against the upper edge of the panel.

31. An office space dividing system including a post, at least one rectangular panel supported by the post, with the rectangular panel having first and second vertically oriented edges and an upper edge, a slotted standard fixed to each of the first and second vertically oriented edges, and a post cap on the post, characterized by:

a depending alignment portion on the post cap which engages the slotted standard, an elongated panel cap removably fixed to the upper edge of the at least one rectangular panel, and a horizontal alignment portion on the post cap, with said panel cap overlying the horizontal alignment portion of the post cap.

32. The office space dividing system of claim 31 including post cover means disposed to cover at least one vertical side of the post, and having an upper end which terminates adjacent to the post cap, and wherein the post cap includes an additional depending alignment portion which engages the post cover means adjacent to said upper end.

* * * * *